US008287018B2

(12) United States Patent
Fandrich et al.

(10) Patent No.: US 8,287,018 B2
(45) Date of Patent: Oct. 16, 2012

(54) AERIAL GRAPPLE APPARATUS AND METHOD FOR HANDLING LOOSE MATERIAL

(75) Inventors: Helmut Edward Fandrich, Abbotsford (CA); Martin Edward Fandrich, Fort Langley (CA)

(73) Assignee: Helmut Fandrich, Abbotsford, B.C. (CA)

( * ) Notice: Subject to any disclaimer, the term of this patent is extended or adjusted under 35 U.S.C. 154(b) by 202 days.

(21) Appl. No.: 12/460,118

(22) Filed: Jul. 13, 2009

(65) Prior Publication Data

US 2010/0008753 A1 Jan. 14, 2010

Related U.S. Application Data

(60) Provisional application No. 61/134,547, filed on Jul. 11, 2008.

(51) Int. Cl.

| | |
|---|---|
| ***B66C 3/00*** | (2006.01) |
| ***B66C 1/42*** | (2006.01) |
| ***B66C 1/58*** | (2006.01) |
| ***B66C 3/04*** | (2006.01) |

(52) U.S. Cl. ..... 294/112; 294/109; 294/110.1

(58) Field of Classification Search ..... 294/112, 294/106, 107, 108, 109, 110.1, 111, 67.1, 294/119; 414/564, 624, 625, 626

See application file for complete search history.

(56) References Cited

U.S. PATENT DOCUMENTS

| | | | | |
|---|---|---|---|---|
| 52,134 | A | 1/1866 | Buckman | |
| 1,151,052 | A * | 8/1915 | Sales | 294/109 |
| 1,462,787 | A | 12/1921 | Degendorfer | |
| 1,735,994 | A * | 11/1929 | Coons | 294/107 |
| 2,362,268 | A * | 11/1944 | Hall | 294/107 |
| 2,586,875 | A * | 2/1952 | Smith | 294/107 |
| 2,676,837 | A * | 4/1954 | Wagner et al. | 294/206 |
| 2,815,242 | A | 12/1957 | Kenyon | |
| 4,943,099 | A | 7/1990 | Gabriel | |
| 5,653,489 | A | 8/1997 | Fandrich | |

* cited by examiner

*Primary Examiner* — Paul T Chin

(57) ABSTRACT

A grapple, designed to grab, ferry, and dump loads of loose material such as mulch, comprising left and right frame members and finger assemblies with specially adapted curved fingers. Load arms connect the grapple to a supporting means, typically a helicopter, and also serve as anchors for finger cables and connecting arms cooperating with the finger assemblies to open and close the grapple. The method of grabbing prominently features using the shape of the fingers and the weight of the grapple and load to penetrate into and under the load. A latching mechanism cooperating with the connecting arms ensures stable ferrying until the remote operator, generally the helicopter pilot, activates an electrical control switch to release the latch and dump the load.

24 Claims, 7 Drawing Sheets

FIG. 6
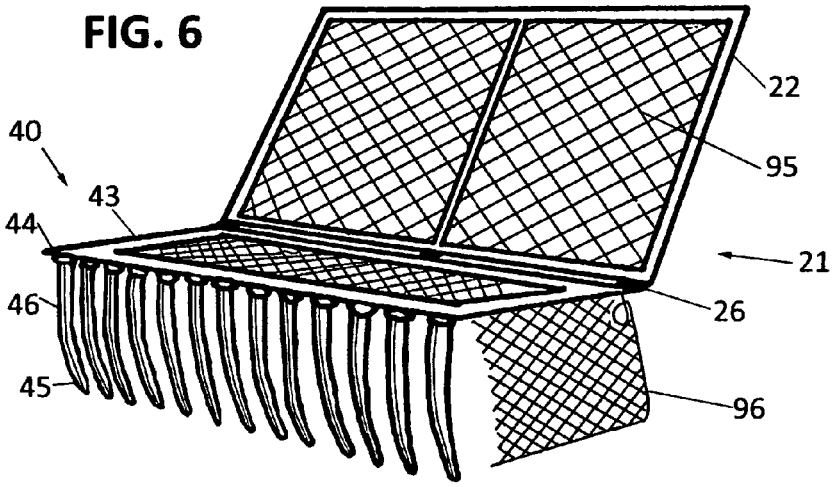
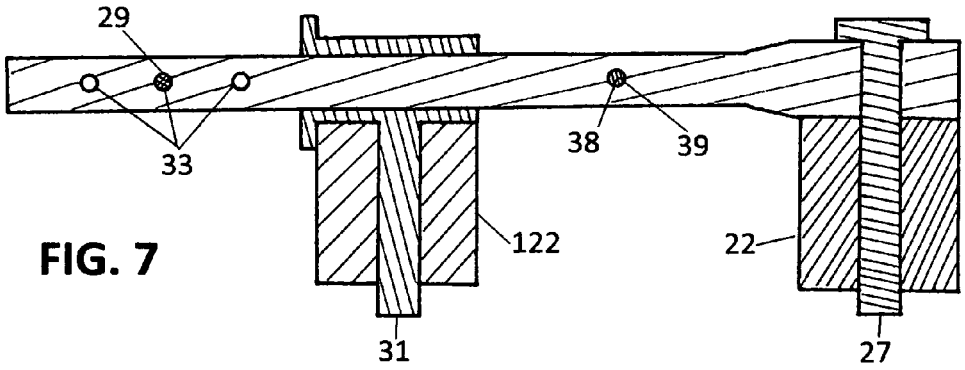
FIG. 7
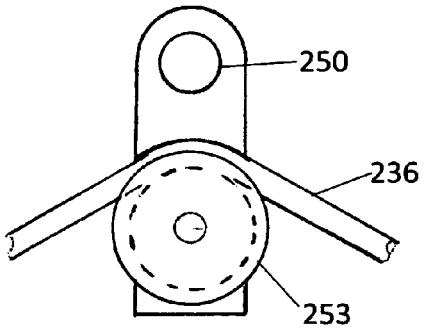
FIG. 8

AERIAL GRAPPLE APPARATUS AND METHOD FOR HANDLING LOOSE MATERIAL

CROSS-REFERENCE TO RELATED APPLICATION

This application claims the priority filing date benefit of U.S. Provisional Patent Application Ser. No. 61/134,547, filed Jul. 11, 2008.

BACKGROUND OF THE INVENTION

The invention relates to a grapple apparatus for grasping, lifting, and releasing loads, particularly adapted for handling loose material such as hay or mulch, and the method of operation of the apparatus.

Grappling devices are common in a number of agricultural and industrial fields and there is a steady demand for improved material-handling apparatus and methods. One fairly recent application for which a well adapted grapple would be useful is the practice of helimulching, i.e. spreading mulch and related materials over large land areas by dropping the material from a helicopter at an altitude suitable to gain the dispersal required. While this is not the only intended application of the present invention, it points out several directions which, individually or in combination, could present goals for improvement over prior art grapples. Specifically, a device used for helimulching must be efficient in its use of people, time, and weight, as many aerial grappling applications take place in wilderness areas where ground-based options are not safe or practical to pursue, and the cost of helicopter time, fuel, and labor is high. An effective grapple for this purpose must also be robust in its ability to manage shock loading, to which helicopters are especially sensitive.

There is no prior art device known to the inventors that combines all of the above strengths. However, an inventory of a few selected prior art grapples will identify the problems traditionally encountered in the development of related machines.

U.S. Pat. No. 52,134, issued Jan. 23, 1866 to Buckman, discloses the semi-automatic operation of a horse hay-fork having fork tines or fingers at the lower ends of its frame halves which are guided, through a combination of levers and hinges, to an essentially horizontal position when retaining a load and an essentially vertical position when releasing a load. The release control requires only the pulling of a rope. However, the rope must be pulled manually, making such a grapple ineffective for working at altitude or in heavily sloped and wooded areas where human access is limited.

U.S. Pat. No. 1,462,787, issued Dec. 19, 1921 to Degendorfer, offers an example of an agricultural fork which explicitly eliminates the need for direct manual intervention with the machine itself; the machine can be controlled remotely by a derrick operator. In this machine the weight of the load even provides some advantage in that it exerts forces on the machine causing it to retain its closed position more firmly. However, the operation still requires multiple cables and therefore some operator skill, and the machine is still confined to ground-based operation.

U.S. Pat. No. 2,815,242, issued Dec. 3, 1957 to Kenyon, discloses a tongs-like device also featuring the intelligent use of weight to help grasp a load, but the weight in this case takes the form of a counterweight, which would dramatically reduce efficiency in a force- and fuel-critical helicopter-towed operation.

Another effective ground-based use of weight is found in U.S. Pat. No. 4,943,099, issued Jul. 24, 1990 to Gabriel, for a magnetic cargo hook that automatically releases when it hits the ground, due to its weight being transferred from a load cable to the ground. However, for aerial operations, the ground-based release would severely limit available altitude and likely applications.

More recently, U.S. Pat. No. 5,653,489, issued Aug. 5, 1997 to present co-inventor Fandrich, provides the best prior art reference as it takes several steps in the right direction while still leaving ample room for improvement. The grapple disclosed in that patent is specifically designed for aerial operation and as such is both lightweight and strong, so that helicopter payload can be maximized. The grapple features shock damping devices to reduce operator risk and fingers capable of squeezing tightly and releasing slowly. However, this earlier grapple is best suited for certain types of materials, particularly for logs, as they are able to be grasped firmly when sufficient clamping force is available. Other materials, especially loose materials such as mulch, do not submit as readily to this type of grabbing action. Minimally, a series of improvements to the existing machine would be required, none of which would be obvious at first.

BRIEF SUMMARY OF THE INVENTION

The apparatus and method of this disclosure provide substantial improvements to the aerial grappling of loose materials, including a method featuring substantially automatic operation.

A grapple apparatus according to the main embodiment of the invention comprises right and left main frame members hinged together at a main hinge, and right and left finger assemblies each hinged to a respective frame member at a respective finger hinge. Each finger assembly comprises a finger frame and plural fingers mounted on the frame. The fingers are designed to penetrate a pile of loose material such as mulch. The finger assemblies rotate relative to the frame members in order to grab and dump loads, and their rotation is limited by inward and outward stops cooperating with the main frame.

The grapple further comprises right and left load arms hinged together at the main hinge. The ends of the load arms are also connected to load cables which in turn are connected by a main cable to a supporting means such as a helicopter. Connecting arms connect each load arm to the finger assembly on the opposite side of the grapple, and finger cables connect each load arm to the finger assembly on the same side of the grapple. The connecting arms therefore assist in holding the grapple closed, while the finger cables assist in holding the grapple open.

Latches on the load arms control the connection between the connecting arms and load arms. The latches are normally engaged but can be disengaged by means of a solenoid connected by power wires to a control switch used by the operator, typically the pilot of the towing helicopter.

The drawings and detailed description following further disclose the main embodiment of the apparatus and its method of operation, followed by a series of options and alternatives, as well as an additional embodiment of the apparatus and its related method of operation, all of which are intended to enable a person having ordinary skill in the art to make and use the invention without limiting the scope thereof to the embodiments particularly described and illustrated herein.

BRIEF DESCRIPTION OF THE DRAWINGS

FIG. 6 is a simplified perspective view showing optional netting enclosure and an advantageous arrangement of fingers on one half of the grapple frame, the other half being essentially a mirror image of the same.

FIG. 7 is a simplified top sectional view of an advantageous arrangement of the main frame stop assembly, the sectioning plane being shown in FIG. 1.

FIG. 8 is a front orthogonal view of an alternative arrangement of the load cables.

Figure 1:
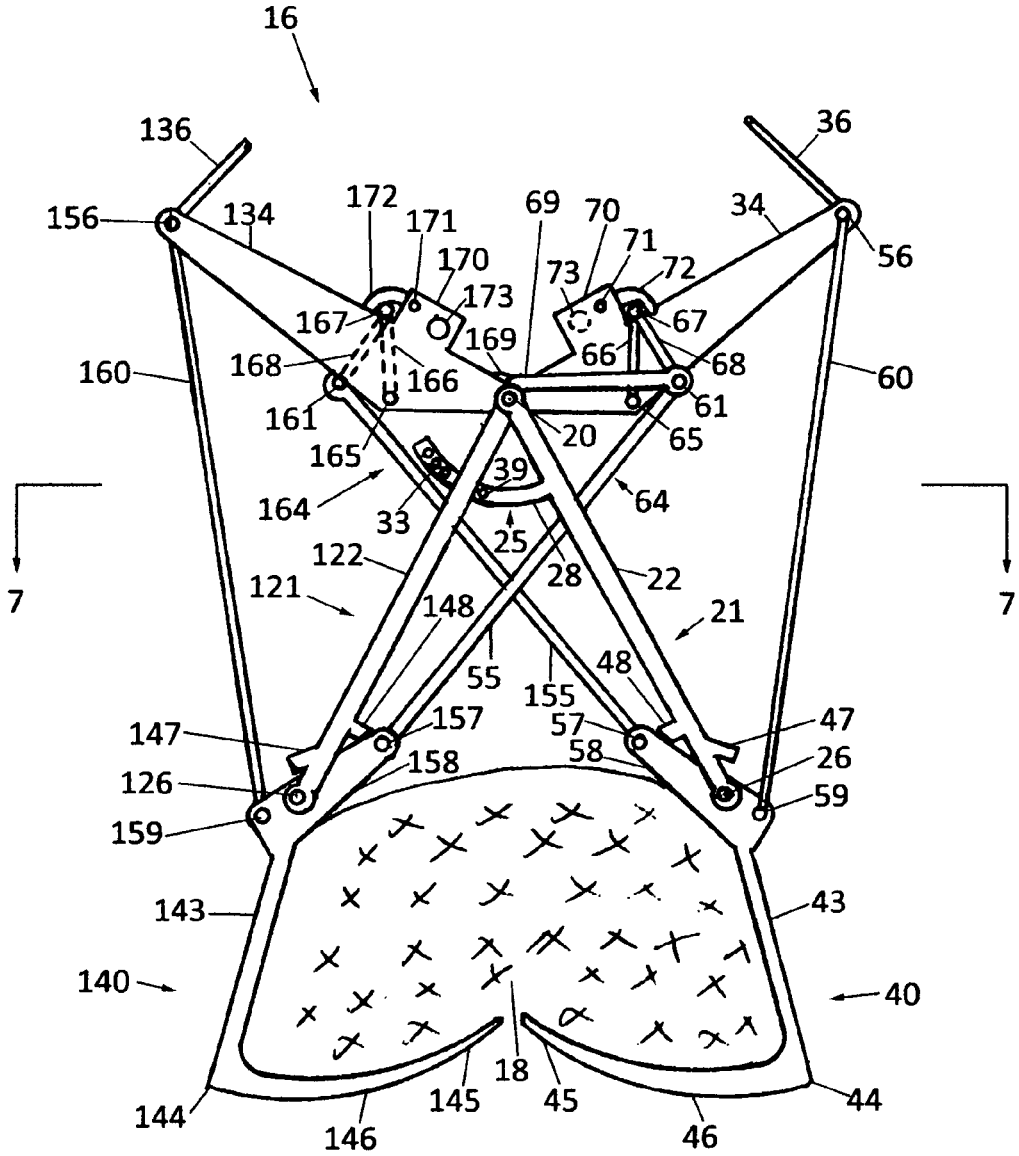
FIG. 1 is a front orthogonal view of the grapple in its closed position while ferrying a load.

The drawings and specification employ the following reference numerals. Paired reference numerals (e.g. "21, 121") indicate functionally identical pairs of elements, one appearing in each of the two halves of the grapple apparatus. Such paired elements will typically be mirror images of each other.

The following reference numerals first appear in the description of the main embodiment, which corresponds to FIGS. 1 through 4:

| | |
|---|---|
| 16 | grapple apparatus |
| 18 | load |
| 20 | main hinge |
| 21, 121 | frame assembly |
| 22, 122 | main frame |
| 25 | main stop assembly |
| 26, 126 | finger hinge |
| 28 | main frame limit rod |
| 29 | main stop pin |
| 33 | main stop hole(s) |
| 34, 134 | load arms |
| 36, 136 | load cables |
| 38 | frame inward stop pin |
| 39 | frame inward stop hole |
| 40, 140 | finger assembly |
| 43, 143 | finger frame |
| 44, 144 | finger mounts |
| 45, 145 | finger tips |
| 46, 146 | fingers |
| 47, 147 | finger open limit stop |
| 48, 148 | finger closed limit stop |
| 50 | load cable mount |
| 54 | main cable |
| 55, 155 | pull arm rods |
| 56, 156 | finger cable arm mount |
| 57, 157 | pull arm hinge |
| 58, 158 | lower arm mount |
| 59, 159 | finger cable mount |
| 60, 160 | finger cable |
| 61, 161 | guide hinge |
| 64, 164 | connecting arm |
| 65, 165 | lever arm hinge |
| 66, 166 | pull arm upper lever |
| 67, 167 | lever hinge |
| 68, 168 | pull arm lower lever |
| 69, 169 | guide lever |
| 70, 170 | latch |
| 71, 171 | latch pin |
| 72, 172 | latch hook |

-continued

| | |
|---|---|
| 73, 173 | solenoid |
| 75, 175 | power wire |
| 76 | main power wire |
| 90 | load arm movement arrow |
| 92 | lever movement arrow |

The following reference numerals first appear in the description of the options and alternatives, which corresponds to FIGS. 5 through 8:

| | |
|---|---|
| 27 | main stop hinge |
| 31 | main stop slider |
| 32 | main stop resilient bushing |
| 35 | frame inward stop bushing |
| 41 | frame damper |
| 49, 149 | finger cable damper rod |
| 51, 151 | finger cable damper mount |
| 52, 152 | finger cable damper |
| 53, 153 | finger cable damper cylinder |
| 62, 162 | lower finger cable |
| 63, 163 | upper finger cable |
| 74, 174 | spring |
| 77, 177 | spring frame mount |
| 78, 178 | spring arm mount |
| 95 | netting enclosure |
| 96-99 | netting mounting springs |
| 236 | alt. load cable |
| 247, 347 | alt. finger open limit stop |
| 250 | alt. load cable mount |
| 253 | cable pulley |
| 260, 360 | alt. finger cable assembly |

Figure 9:
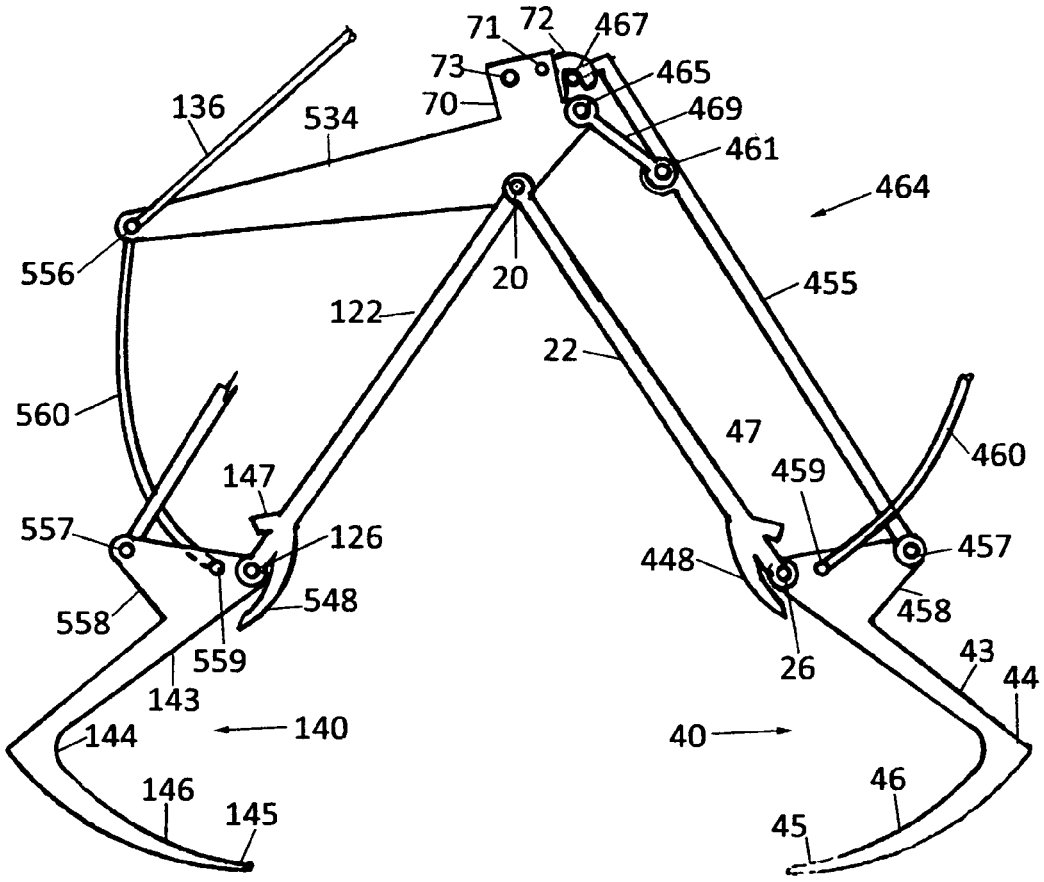
FIG. 9 is a front orthogonal view of an additional embodiment of the grapple apparatus showing an alternative connecting arm on the right half of the grapple, the other connecting arm being essentially a mirror image of the same.

The following reference numerals first appear in the description of the additional embodiment, which corresponds to FIG. 9:

| | |
|---|---|
| 434, 534 | alt. load arm |
| 448, 548 | alt. finger closed limit stop |
| 455, 555 | push arm rod |
| 456, 556 | alt. finger cable arm mount |
| 457, 557 | push arm lower hinge |
| 458, 558 | alt. lower arm mount |
| 459, 559 | alt. finger cable mount |
| 460, 560 | alt. finger cable |
| 461, 561 | alt. guide hinge |
| 464, 564 | alt. connecting arm |
| 465, 565 | alt. lever arm hinge |
| 467, 567 | push arm pin |
| 469, 569 | alt. guide lever |

DETAILED DESCRIPTION OF THE INVENTION

The grapple apparatus 16 described herein comprises right and left halves connected at a main hinge 20. When description is given for only one half of the grapple, and additional reference numerals are given in parentheses, it is to be understood that the opposite half of the grapple acts simultaneously with the half described and in a similar way thereto, generally as a mirror image thereof. This practice shall be employed selectively in order to optimize clarity and, where possible, simplicity.

FIG. 1

Description of the Main Embodiment

As seen in FIG. 1, a grapple apparatus 16 according to the invention comprises right and left frame assemblies 21 and 121 having inner portions, here designated as right and left main frame members 22 and 122 respectively, hinged together at main hinge 20. The frame assemblies 21 and 121 also have outer portions, here designated as right and left finger assemblies 40 and 140 respectively, joined to respective main frame members 22 and 122 by right and left finger hinges 26 and 126 respectively.

The main frame members 22 and 122 are also bridged by a main stop assembly 25 which cooperates with main frame members 22 and 122 to limit outward rotational movement of frame assemblies 21 and 121 with respect to the main hinge 20. Main stop assembly 25 comprises main frame limit rod 28, which is attached to main frame 22, and one or more main stop holes 33 into which main stop pin 29 (shown in FIG. 7) may be placed to fix an outer limit to the rotation of frame assemblies 21 and 121 about main hinge 20 and thereby limit the extent to which the grapple is able to open. Similarly, main stop assembly 25 may further comprise one or more frame inward stop holes 39 into which frame inward stop pin 38 (shown in FIG. 7) may be placed to fix an inner limit to the rotation of frame assemblies 21 and 121 about main hinge 20 and thereby limit the extent to which the grapple is able to close.

Finger assembly 40 (140) comprises a finger frame 43 (143) to which plural fingers 46 (146) are fastened, said fingers having inner portions fastened to finger frame 43 (143) at finger mounts 44 (144) and outer portions, here designated as finger tips 45 (145), designed to penetrate a pile of loose material (not shown) such as, but not limited to, mulch.

Finger frame 43 (143) is hinged to rotate with respect to main frame 22 (122) about finger hinge 26 (126), said rotation being limited by finger open limit stop 47 (147) and finger closed limit stop 48 (148) which are fastened to main frame 22 (122). Finger open limit stop 47 (147) is adapted to contact finger assembly 40 (140) to limit its outward rotation relative to main frame 22 (122). Finger closed limit stop 48 (148) is adapted to contact finger assembly 40 (140) to limit its inward rotation relative to main frame 22 (122).

Figure 2:
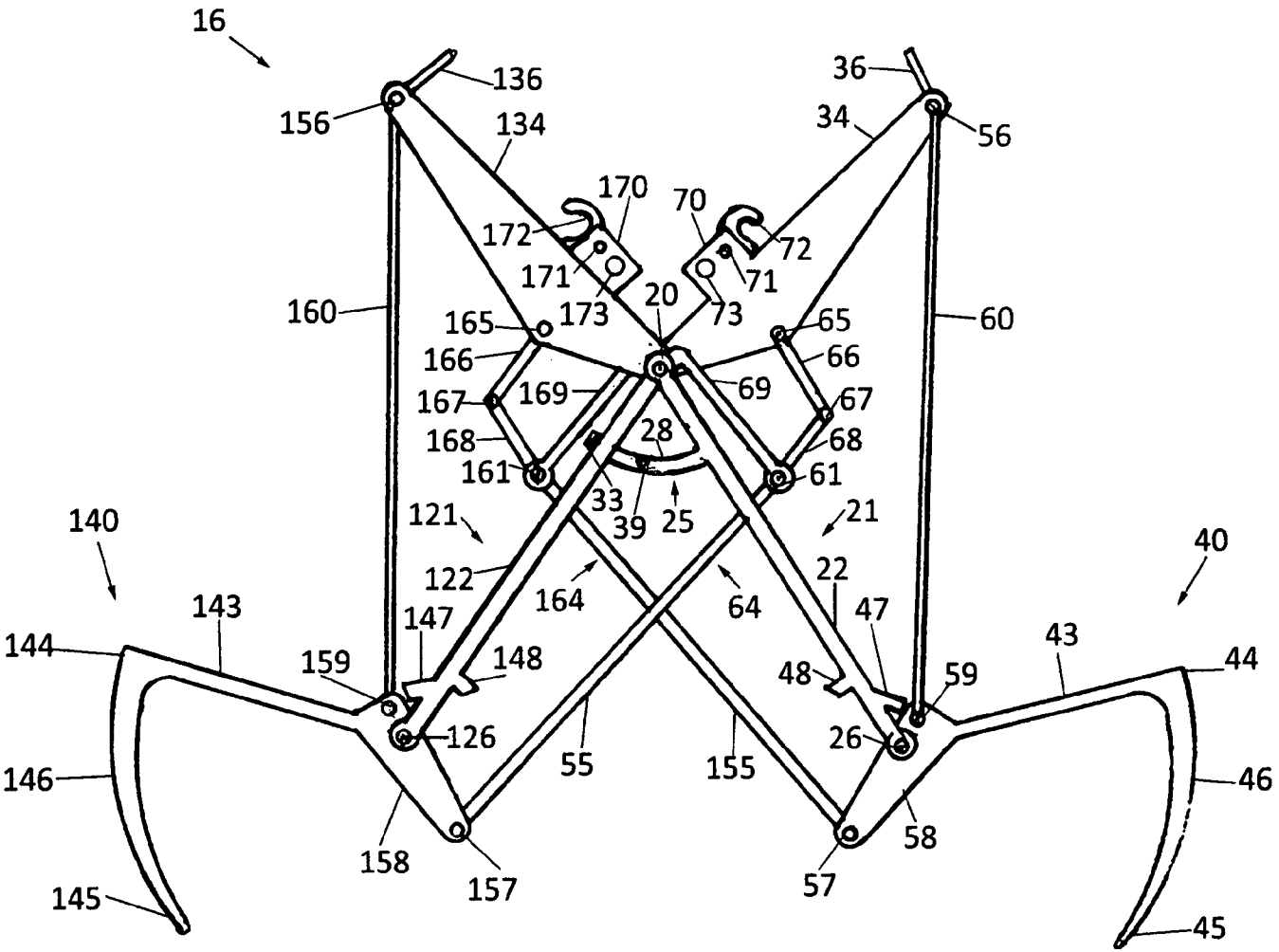
FIG. 2 is a front orthogonal view of the grapple in its open position after releasing a load.

When the grapple is fully closed, as seen in FIG. 1, fingers 46 (146) extend in a generally horizontal direction. When the grapple is fully open, as seen in FIG. 2, fingers 46 (146) extend in a generally vertical direction.

Returning to FIG. 1, the grapple further comprises right and left load arms 34 and 134 having inner portions hinged together at the main hinge 20, and outer portions cooperating with right and left load cables 36 and 136 respectively. Load cables 36 and 136 are connected at load cable mount 50 (shown in FIG. 4) to main cable 54 (shown in FIG. 4) which is typically suspended from a helicopter.

Load arms 34 and 134 are disposed symmetrically on opposite sides of a vertical plane of symmetry passing through main hinge 20 and parallel to load arms 34 and 134. Likewise, right and left connecting arms 64 and 164, as well as right and left latches 70 and 170, are disposed symmetrically on opposite sides of the same vertical plane.

Connecting arms 64 and 164 are connected at their respective upper termini to load arms 34 and 134, respectively. The lower terminus of right connecting arm 64 is connected to left finger assembly 140, and the lower terminus of left connecting arm 164 is connected to right finger assembly 40.

Connecting arm 64 (164) comprises pull arm upper lever 66 (166), pull arm lower lever 68 (168), pull arm rod 55 (155), and a series of hinges. The upper portion of pull arm upper lever 66 (166) is hinged to load arm 34 (134) by lever arm hinge 65 (165). The lower portion of pull arm upper lever 66 (166) is hinged to the upper portion of pull arm lower lever 68 (168) by lever hinge 67 (167). The lower portion of pull arm lower lever 68 (168) is hinged to the upper portion of pull arm rod 55 (155) by guide hinge 61 (161). The lower portion of pull arm rod 55 (155) is hinged to the upper portion of lower arm mount 158 (58) by pull arm hinge 157 (57). The lower portion of lower arm mount 158 (58) is connected to finger frame 143 (43).

Right and left guide levers 69 and 169 are hinged at their inner portions to main hinge 20, about which guide levers 69 and 169 rotate. The other end of guide lever 69 (169) is hinged to pull arm lower lever 68 (168) and pull arm rod 55 (155) at guide hinge 61 (161).

Right and left latches 70 and 170 are connected to load arms 34 and 134 respectively. Latch 70 (170) has a latch hook 72 (172) designed to engage automatically with lever hinge 67 (167) and to disengage upon operator control. Latch hook 72 (172) is capable of articulation about latch pin 71 (171).

Right and left solenoids 73 and 173 are connected to latches 70 and 170 respectively, and disengage said latches when energized by the operator (not shown), who sends an electrical current to main power wire 76 (shown in FIG. 4) and thence to right and left power wires 75 (shown in FIG. 4) and 175, which in turn energize solenoids 73 and 173 respectively. It is desirable that the latches disengage simultaneously.

Right and left finger cables 60 and 160 serve as flexible tensile links connecting respective load arms 34 and 134 to respective finger assemblies 40 and 140. Finger cable 60 (160) has an upper portion connected to finger cable arm mount 56 (156) on the outer portion of load arm 34 (134) and a lower portion connected to finger cable mount 59 (159) on finger frame 43 (143).

Operation—General

The grapple's operation is characterized by a cycle of (a) grabbing and lifting a load, (b) ferrying the load to a desired location, (c) dumping the load, and (d) resetting the mechanism in preparation for grabbing the next load. For greatest clarity this cycle will be described beginning and ending with the ferrying stage as seen in FIG. 1.

It will be assumed in this description that the grapple is suspended from a helicopter (not shown) and that "the operator" refers to said helicopter's pilot (not shown). However, this assumption is not intended to limit the scope of conditions in which the grapple may be operated. The operation as described can be easily extended to include other means by which the grapple may be supported (e.g. by a ground-based crane) and/or controlled (e.g. by wireless remote control).

It will also be assumed, for the illustrative purposes of this description, that the load being manipulated comprises loose material such as mulch; however, this single example of particularly advantageous material is not intended to provide or suggest any limitation as to other types of loads the invention, in various expressions, could effectively manipulate.

Operation—Ferrying

FIG. 1 shows the grapple apparatus 16 in the condition of ferrying a load 18.

When the grapple is supported by a helicopter or other load-carrying device, main cable 54 (shown in FIG. 4) supports load cables 36 and 136, which in turn support the outer portions of load arms 34 and 134 hinged about main hinge 20. Finger cable 60 (160) connects load arm 34 (134) to finger assembly 40 (140). The solenoid 73 (173) on latch 70 (170) is normally de-energized, so latch hook 72 (172) holds lever hinge 67 (167), maintaining the upward and inward pulling force of connecting arm 64 (164) acting on finger assembly 140 (40) on the opposite half of the grapple. Finger assemblies 40 and 140 enclose the load, which generally sits on top of fingers 46 and 146.

Generally the grapple is prevented from closing further by one or more of the following conditions being met:

(a) finger cable 60 (160) is taut;

(b) finger assembly 40 (140) is in contact with finger closed limit stop 48 (148) on main frame 22 (122); and/or (c) main frame 122 is in contact with optional frame inward stop pin 38 (shown in FIG. 7), if pin 38 is present in frame inward stop hole 39; and/or (d) the load 18 is such that forces on it are sufficient to keep finger assemblies 40 and 140 apart.

Condition (a) is particularly advantageous as tension in finger cables 60 and 160 will ensure minimal shock loading when the load is released.

The precise spatial relationships between parts of the grapple may vary from load to load. However, in all of the above ferrying conditions, the load is securely retained and all parts of the grapple maintain essentially constant positions relative to one another.

FIG. 2

Operation—Dumping

The dumping operation may be executed at any altitude suitable for the application, provided that t he loaded grapple is airborne, i.e. the preponderance of its weight is supported by main cable 54.

The helicopter or other suspending device may be stationary or in motion at a speed suitable for the application. For example, when aerially spreading thin layers of mulch over large areas, it can be advantageous to release the load from a moving helicopter for broader dispersal and higher efficiency.

When the load is to be released, the operator activates an electrical control switch (not shown) which energizes solenoid 73 (173) which, in turn, causes latch 70 (170) to disengage. As lever hinge 67 (167) is released from latch hook 72 (172), connecting arm 64 (164) is able to straighten and extend, permitting frame assemblies 21 and 121 to move away from each other by rotating outward about main hinge 20. Also, the disengagement of connecting arm 64 (164) from latch 70 (170) partially relieves load arm 34 (134) of the weight of the grapple and load, causing the outer portion of said load arm to move upward and inward relative to main hinge 20 due to tension on load cable 36 (136). This movement of load arm 34 (134) also pulls upward on finger cable 60 (160), tightening said cable and causing outward rotation of finger assembly 40 (140) about finger hinge 26 (126) and of frame assembly 21 (121) about main hinge 20. If finger cable 60 (160) has already been under tension prior to dumping, minimal shock loading will be transferred to the helicopter or other suspending device.

The grapple will continue to open further until at least one of the following conditions is met:

(a) Finger assembly 40 (140) contacts finger open limit stop 47 (147).

(b) Main frame 122 contacts main stop pin 29 (shown in FIG. 7) in main stop hole 33.

With the grapple thus opened, especially with the large distance between finger assemblies 40 and 140 and the generally vertical orientation of fingers 46 and 146, the load (not shown) drops.

After dumping, the grapple may be safely ferried in the resulting empty open condition to the subsequent site where a load is to be grabbed.

Figure 3:
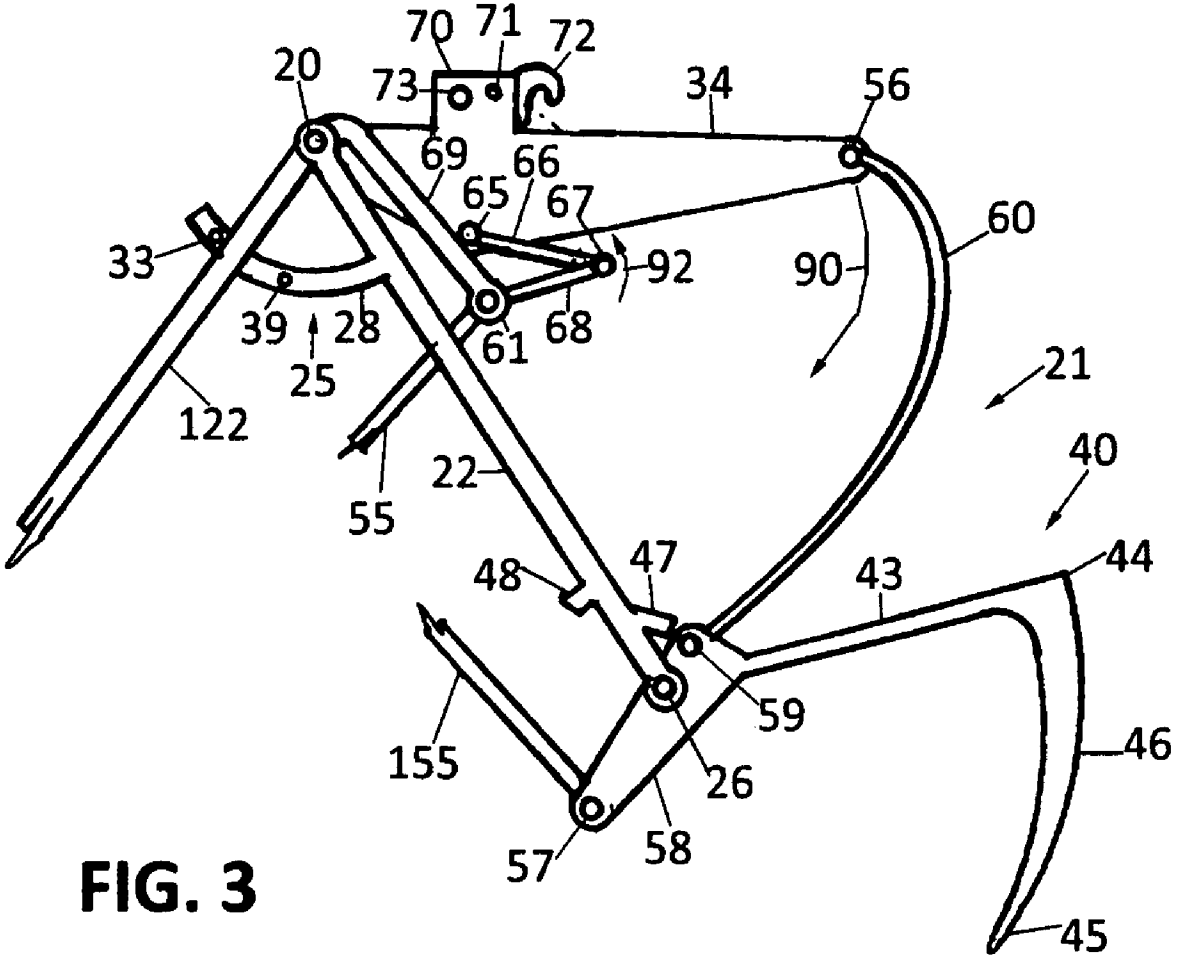
FIG. 3 is a front orthogonal view featuring the right half of the grapple during its reset operation, the left half being essentially a mirror image of the same.
Figure 4:
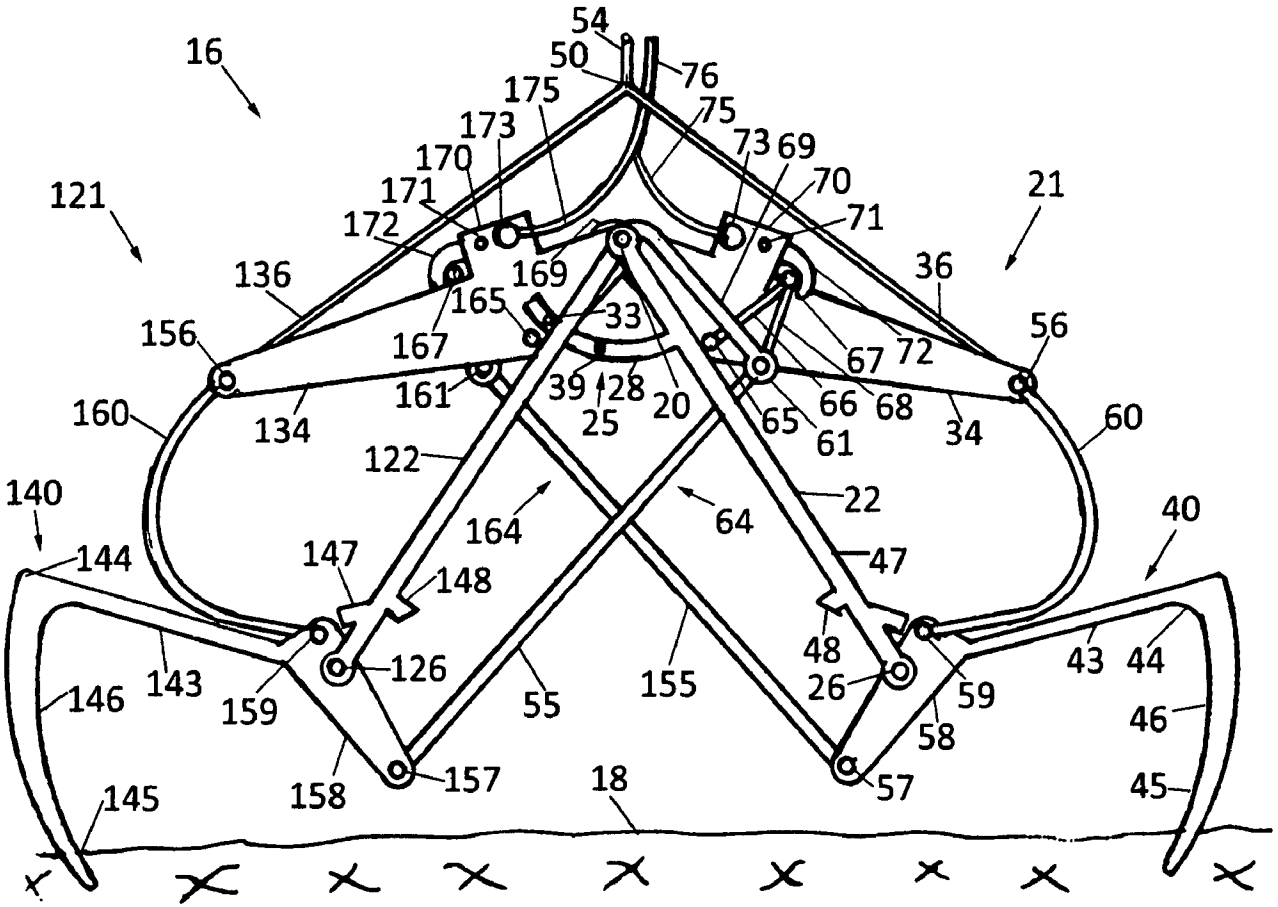
FIG. 4 is a front orthogonal view of the grapple after completing its reset operation and ready to grasp a load.

FIGS. 3 and 4

Operation—Resetting

FIG. 3 shows one load arm 34 and related parts at an arbitrary point during the resetting operation; the other load arm 134 (not shown in FIG. 3) and its related parts act in essentially the same way. FIG. 4 shows the entire grapple when the resetting operation is completed. Simultaneous reference to both drawings is recommended for this portion of the description.

The resetting operation is executed at the site where the next load is to be grabbed. The operator lowers the grapple to the ground. As main cable 54 (shown in FIG. 4) lowers and slackens, the weight of load arm 34 (134) causes said arm to rotate about main hinge 20, in the direction of arrow 90, toward a lowered position.

Pull arm upper lever 66 rotates about lever arm hinge 65 in the direction of arrow 92 until lever hinge 67 engages latch hook 72 on latch 70. Likewise, pull arm upper lever 166 rotates about lever arm hinge 165 until lever hinge 167 engages latch hook 172 on latch 170, the result of which operation is seen in FIG. 4. The mechanisms in each half of the grapple, though equivalent in function, act essentially independently of each other and may not occur exactly simultaneously, especially on uneven or steeply sloped ground.

Once latch hooks 72 and 172 are engaged with lever hinges 67 and 167 respectively, the grapple is considered to be "reset" and prepared to grab the next load, which it may do immediately and in the same location where it has just been reset.

The reset operation requires only the machine's own weight and, like all other steps of the grapple's cycle of operation, can be performed without direct manual intervention. The reset operation also, like all other steps in the grapple's cycle of operation other than dumping the load, can be performed without need for external power.

Operation—Grabbing and Lifting

Continuing with FIG. 4, the grapple 16 straddles the load 18 and is supported by its fingers 46 and 146 on the load or ground. When main cable 54 is lifted, load cables 36 and 136 lift the outer ends of load arms 34 and 134 respectively, which rotate about main hinge 20. The top of connecting arm 64 (164) is lifted by load arm 34 (134), transmitting force to the opposite finger assembly 140 (40), which rotates inwardly about finger hinge 126 (26) and also causes inward rotation of frame assembly 121 (21) about main hinge 20. As finger assemblies 40 and 140 rotate, fingers 46 and 146 penetrate load 18. The added weight of the load on fingers 46 and 146 allows a greater upward force to be applied to main cable 54, which results in a greater torque applied to rotate finger assemblies 40 and 140 and corresponding greater penetrating force on the load.

When the torque on finger assemblies 40 and 140 is less than that required for fingers 46 and 146 to penetrate the load, the grapple begins to lift. This normally results in a decrease of the force required to penetrate the load, so finger assemblies 40 and 140 will start to rotate again and fingers 46 and 146 will penetrate farther into the load. There is minimal disturbance in the load as fingers 46 (146) rotate about finger hinge 26 (126).

Finger assembly 40 (140) continues to rotate until at least one of the following conditions is met:

(a) the force required to penetrate the load 18 is greater than that available on fingers 46 (146);

(b) finger cable 60 (160) becomes taut;

(c) finger assembly 40 (140) contacts finger closed limit stop 48 (148) on main frame 22 (122); and/or (d) main frame 122 contacts optional frame inward stop pin 38 (shown in FIG. 7), if pin 38 is present in frame inward stop hole 39.

If condition (c) is the first to be met, frame assembly 21 (121), which comprises main frame 22 (122) and finger assembly 40 (140), may continue to rotate as a single unit about main hinge 20 until condition (a), (b), and/or (d) is met.

As the upward force on main cable 54 increases, the loaded grapple lifts off. The grapple, once airborne, exhibits the stable closed condition it will retain while being ferried to the dumping site. Thus it may be ferried as already described, and the cycle of grabbing, ferrying, dumping, and resetting can be repeated as many times as desired without interruption.

The grapple when operated as described offers increased safety and reduced cost, as all stages of its operating cycle can be controlled by the remote operator and therefore no ground crew is required. Further, no specialized skills are required of the operator as most load-handling is performed automatically by the grapple; for example, the operator need only lift the grapple in order to make it grab, and need only activate a switch in order to make the grapple dump.

Options and Alternatives

The description thus far has disclosed a main embodiment of the grapple apparatus and of the method used to operate it. What follows is a discussion of some optional components that may be added to the main embodiment, some particularly advantageous expressions of certain structures therein, and some alternatives to components of the main embodiment, including a second embodiment of the grapple featuring an alternative connecting arm.

FIG. 5

Optional Damping Mechanisms

Shock absorption is most critical at the dumping stage of the grapple's operation. At this point, large forces are being transferred instantaneously, and helicopters are particularly sensitive to shock loading. While for most applications the tension in finger cables 60 and 160 (such as in FIGS. 1 and 2) prior to dumping minimizes shock loading, it is sometimes desirable to add additional damping capability at key places on the grapple. This is especially true when grasping unusually shaped loads that leave finger assemblies 40 and 140 further apart and finger cables 60 and 160 more slack than would otherwise be considered optimal behavior. In such a case, the rapid tightening of finger cables 60 and 160 would generate a larger-than-usual shock load.

Figure 5:
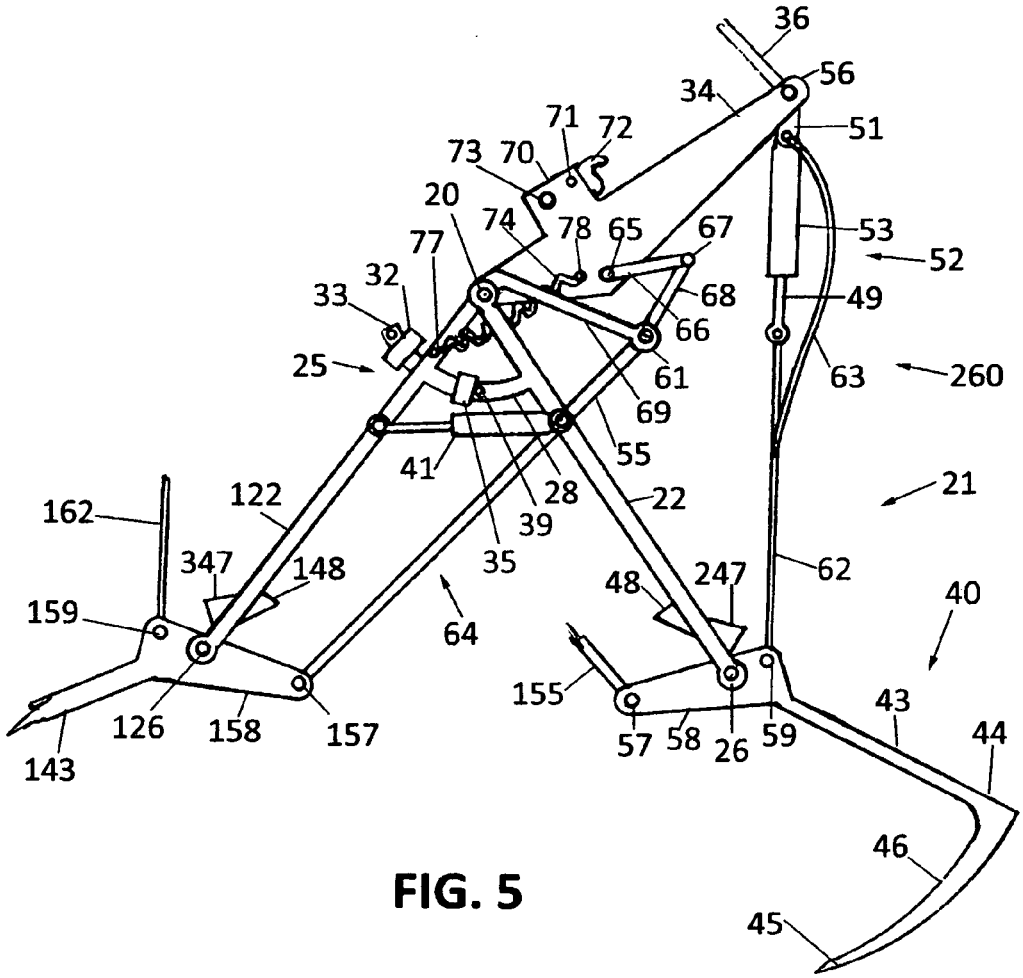
FIG. 5 is a front orthogonal view of the grapple showing optional damping mechanisms and an optional spring on the right half of the grapple, the left half being essentially a mirror image of the same.

This potential problem can be alleviated with one or more of the following modifications, all seen in FIG. 5.

A first possible modification involves attaching an optional frame damper 41 bridging main frame members 22 and 122 so that resistance in frame damper 41 will retard its extension and thus reduce the speed of frame opening.

A second possible modification involves replacing finger cable 60 (160) from the main embodiment (as seen in FIGS. 1 through 4) with alternative finger cable assembly 260 (360) as seen in FIG. 5. Finger cable assembly 260 (360) includes a finger cable damper 52 (152) having (a) a fixed upper cylinder 53 (153) attached to finger cable damper mount 51 (151), which is attached to finger cable arm mount 56 (156) on load arm 34 (134), and (b) a movable lower rod 49 (149) attached to the upper end of lower finger cable 62 (162), the lower end of which is attached to finger cable mount 59 (159).

Finger cable assembly 260 (360) further comprises upper finger cable 63 (163), the upper end of which is attached to finger cable damper mount 51 (151), and the lower end of which is clamped to lower finger cable 62 (162) at a point such that upper finger cable 63 (163) becomes taut just before finger cable damper 52 (152) is fully extended.

Thus, upper finger cable 63 (163) will be slack at first, allowing the pace at which finger cable assembly 260 (360) extends to be largely controlled and partially retarded by the extension of finger cable damper 52 (152). When finger cable damper rod 49 (149) has extended sufficiently for upper finger cable 63 (163) to become taut, finger cable assembly 260 (360) will behave similarly to finger cable 60 (160) in the main embodiment previously described.

A third possible modification involves replacing finger open limit stops 47 and 147 from the main embodiment (as seen in FIGS. 1 through 4) with alternative finger open limit stops 247 and 347 (seen in FIG. 5), comprising resilient material such as urethane placed where the stop would normally contact finger assemblies 40 and 140 respectively. The resilient material in stop 247 (347) will deform upon contact with finger assembly 40 (140) and absorb some of its kinetic energy.

A fourth possible modification involves introducing an optional resilient bushing 32 to travel over main frame limit rod 28 between main frame 122 and the main stop hole 33 in which main stop pin 29 is placed. Main stop resilient bushing 32 comprises resilient material in order to absorb shocks when rapid outward rotation of main frame members 22 and 122 is halted by main stop assembly 25. (FIG. 5 also depicts an optional frame inward stop bushing 35 which could serve a similar function by absorbing energy from inward rotation of main frame members 22 and 122.)

The above modifications may be employed individually or in combination as the application requires. Whichever combination of modifications is implemented, the operating cycle of the grapple remains essentially the same as that described for the main embodiment.

Optional Springs

The resetting operation described as part of the main embodiment (and seen in FIGS. 3 and 4) is already simple and effective, relying as it does only on the weight of load arm 34 (134) to reset latch 70 (170). However, in some cases it may be desirable to have downwardly and inwardly directed force acting on load arm 34 (134) in addition to its weight. One example of such a case could involve attempting to reset the grapple while it is positioned on a steep hillside such that the right half of the grapple, including load arm 34, stands much lower than the left half. Resetting latch 70 on load arm 34 in this case would require some inward force, which could be provided by the introduction of an extension spring. As seen in FIG. 5, spring 74, mounted between spring frame mount 177 on main frame 122 and spring arm mount 78 on load arm 34, is positioned advantageously to exert sufficient pulling force to supplement the weight of load arm 34 in order to complete the resetting operation.

Likewise, though not explicitly shown in FIG. 5, the equivalent spring 174, mounted between spring frame mount 77 on main frame 22 and spring arm mount 178 on load arm 134, would provide similar function.

Apart from a possible increase in the efficiency and effectiveness of the resetting operation provided by the springs, the operating cycle of the grapple remains essentially the same as that described for the main embodiment.

FIG. 6

Optional Netting Enclosure

The ability of the grapple to retain certain types of loads can be improved if the preponderance of the grapple's frame 21 (and 121, not shown in FIG. 6) is enclosed with netting material 95 as seen in FIG. 6. Further, the effectiveness of netting material 95 in enclosing the load being grabbed, lifted, or ferried can be improved by installing netting mounting springs 96, 97, 98, and 99 on the edges of finger frames 43 and 143 not already joined by finger mounts 44 or 144 or finger hinges 26 or 126 to other components.

The operating cycle of the grapple with netting is the same as that described for the main embodiment.

Advantageous Arrangement of Fingers

In an advantageous arrangement, seen in FIG. 6, the shape of each finger 46 (146) is based on an arc with radius approximately equal to the perpendicular distance from its respective finger mount 44 (144) to finger hinge 26 (126) where main frame 22 (122) meets finger assembly 40 (140). Thus, the distance from finger mount 44 (144) to finger hinge 26 (126) is approximately equal to the distance from finger tip 45 (145) to finger hinge 26 (126).

The spacing and number of fingers 46 (146) on finger frame 43 (143) are variable. Fingers 46 (146) may be detached from finger frame 43 (143) at finger mounts 44 (144) in order to vary their spacing and/or number, and/or to interchangeably install fingers of various sizes and types (not shown) to accommodate particular characteristics of a load to be handled. It is not necessary that fingers are uniform.

Generally, changes to the spacing, number, size, and/or type of fingers will change the effectiveness of the grapple for certain types of loads, but will not change the operating cycle as described for the main embodiment, which remains essentially the same.

FIG. 7

Advantageous Arrangement of Main Stop Assembly

In an advantageous arrangement of main stop assembly 25, seen in FIG. 7 as a simplified top sectional view (the sectioning plane being shown in FIG. 1), main frame limit rod 28 is hinged at its proximal end to main frame 22 by main stop hinge 27. The intermediate portion of main frame limit rod 28 is encircled by main stop slider 31, which includes a bolt that attaches to main frame 122 in such a way that main stop slider 31 is free to partially rotate about the axis of the bolt. As the frame opens, main stop slider 31 travels toward the distal end of main frame limit rod 28 until stopped by contact with main stop pin 29 placed in a main stop hole 33 located on main frame limit rod 28.

Likewise, if frame inward stop pin 38 (not shown) is present in frame inward stop hole 39, main stop slider 31 will travel toward the proximal end of main frame limit rod 28, as the frame closes, until stopped by contact with frame inward stop pin 38.

This arrangement of main stop assembly 25 accommodates a wide range of realistic conditions for controlling the opening and closing of the grapple, as main frame limit rod 28 can rotate freely with respect to main frame 22 about main stop hinge 27, and can also move freely back and forth within slider 31, which itself can rotate freely with respect to main frame 122.

In the operation of the grapple using this arrangement, unlike the operating cycle described for the main embodiment, it is main stop slider 31 (rather than main frame 122 directly) that contacts main stop pin 29 at the dumping stage, and frame inward stop pin 38 (if present) at the grabbing stage. All other elements of the operating cycle remain essentially the same.

FIG. 8

Alternative Arrangement of Load Cables

As seen in FIG. 8, load cables 36 and 136 can be replaced by an alternative load cable 236 which is a single piece of cable joined at each end to a load arm 34 or 134 (see FIG. 4) and passing over a cable pulley 253 attached to alternative load cable mount 250, which in turn is attached to main cable 54 (see FIG. 4). The rolling action of load cable 236 over cable pulley 253 allows the forces on the two ends of load cable 236 to equalize and thereby essentially equalize the forces on the two load arms 34 and 134.

Apart from possibly improved performance with certain types of loads, the operating cycle with this arrangement of load cables remains essentially the same as that described for the main embodiment.

FIG. 9

Additional Embodiment Featuring Alternative Connecting Arm

Many systems in this additional embodiment are unchanged from the main embodiment as seen in FIGS. 1 through 4:

(a) right and left frame assemblies 21 and 121 are still hinged together at main hinge 20, and frame assembly 21 (121) still comprises main frame 22 (122) and finger assembly 40 (140) hinged together at finger hinge 26 (126);

(b) main frame stop assembly 25 still bridges main frame members 22 and 122 and still comprises main frame limit rod 28, main stop pin 29, and main stop hole 33, as well as frame inward stop hole 39 and frame inward stop pin 38 (if present);

(c) finger assembly 40 (140) still comprises finger frame 43 (143) and fingers 46 (146), the fingers still being mounted to finger frame 43 (143) at finger mounts 44 (144) and having finger tips 45 (145);

(d) finger open limit stop 47 (147) on main frame 22 (122) still limits inward rotational movement of finger assembly 40 (140);

(e) the grapple is still connected to a helicopter or other supporting apparatus by load cables 36 and 136, which are connected to main cable 54 at load cable mount 50;

(f) latch 70 (170) still comprises latch pin 71 (171) and latch hook 72 (172), and is still released by momentary power to solenoid 73 (173), which is still connected to a power source and control switch (not shown) by power wires 75 and 175 and main power wire 76.

The additional embodiment further comprises several components that are substantially altered with respect to the main embodiment, which are described as follows with reference to FIG. 9. Where only one half of a pair of components is shown, it is to be understood that the other half generally acts as a mirror image of the same.

Right and left alternative load arms 434 (not shown) and 534 are hinged together at main hinge 20. Load arm 534 (434) is arranged so that it has a longer portion on one side of main hinge 20 that cooperates with load cable 136 (36) and a shorter portion on the opposite side of main hinge 20 that cooperates with alternative connecting arm 464 (and 564, not shown).

Alternative connecting arm 464 (564) comprises push arm rod 455 (and 555, partially shown), the lower portion of which is connected to push arm lower hinge 457 (557) on alternative lower arm mount 458 (558), and the upper portion of which, terminating with push arm pin 467 (and 567, not shown), is angled to engage with latch hook 72 (172) on latch 70 (170).

The movement of connecting arm 464 (564) is guided by alternative guide lever 469 (and 569, not shown), which is mounted at one end to load arm 534 (434) at alternative lever arm hinge 465 (and 565, not shown) and at the other end to push arm rod 455 (555) at alternative guide hinge 461 (and 561, not shown).

The embodiment further comprises finger cables similar to those in the main embodiment. Alternative finger cable 560 (and 460, partially shown) is connected between alternative finger cable arm mount 556 (and 456, not shown) on load arm 534 (434) and alternative finger cable mount 559 (459) on lower arm mount 558 (458).

The embodiment further comprises right and left alternative finger closed limit stops 448 and 548 attached to main frame members 22 and 122 respectively. Finger closed limit stop 448 (548) has an elongated shape relative to corresponding finger closed limit stop 48 (148) in the main embodiment (see FIGS. 1 through 4) to accommodate the altered shape of lower arm mounts 458 and 558 (see FIG. 9) relative to corresponding lower arm mounts 58 and 158 in the main embodiment (see FIGS. 1 through 4).

Operation of Additional Embodiment

The operation of this additional embodiment follows the same cycle as the main embodiment. As with the main embodiment, the operating cycle will be described beginning and ending with the ferrying stage. Where deviations from the operation of the main embodiment are not explicitly mentioned, it is to be understood that the operation of the additional embodiment is essentially the same with respect to the point not mentioned.

Similarly, all components common to the two embodiments function identically in each embodiment, except where specifically noted in the operational description below. It is further noted that, with respect to function, the following components may be treated as identical between embodiments:

(a) finger cable 460 (560) in the additional embodiment is functionally identical to finger cable 60 (160) in the main embodiment;

(b) finger closed limit stop 448 (548) in the additional embodiment is functionally identical to finger closed limit stop 48 (148) in the main embodiment; and (c) the outer portion of load arm 534 (434), that is, the portion between main hinge 20 and finger cable arm mount 556 (456) inclusively, in the additional embodiment is functionally identical to the outer portion of load arm 134 (34), that is, the portion between main hinge 20 and finger cable arm mount 156 (56) inclusively, in the main embodiment.

Simultaneous reference to FIGS. 1 through 4 (for the appropriate stages of operation of the main embodiment) and to FIG. 9 (for the additional embodiment) is recommended, especially as the latter is primarily understood in direct comparison to the former.

The ferrying operation of the additional embodiment is identical to that of the main embodiment, except that (a) it is push arm pin 467 (567), rather than lever hinge 67 (167), that remains engaged with latch hook 72 (172) as long as solenoid 73 (173) remains de-energized, and (b) the force from connecting arm 464 (564) acting on finger assembly 140 (40) is a downward and inward pushing force in the additional embodiment, in contrast to the upward and inward pulling force from connecting arm 64 (164) in the main embodiment.

The dumping and resetting operations show more variation between embodiments.

In the additional embodiment, when momentary power from the operator's electrical control switch (not shown) energizes solenoid 73 (173) causing latch 70 (170) to disengage, push arm pin 467 (567) is released from latch hook 72 (172). Connecting arm 464 (564) is able to move away from latch 70 (170), being limited by movement of arm 469 (569) about lever arm hinge 465 (565) and guide hinge 461 (561), and being further limited by movement about push arm lower hinge 457 (557). Frame assemblies 21 and 121 are permitted to move away from each other by rotating about main hinge 20. Also, the disengagement of connecting arm 464 (564) from latch 70 (170) partially relieves load arm 534 (434) of the weight of the grapple and load, causing the outer portion of said load arm to move upward and inward relative to main hinge 20 due to tension on load cable 136 (36). This movement of load arm 534 (434) also pulls upward on finger cable 560 (460), tightening said cable and causing outward rotation of finger assembly 140 (40) about finger hinge 126 (26) and of frame assembly 121 (21) about main hinge 20.

Also, though the two embodiments share a common latch 70 (170), the additional embodiment is reset when push arm rod 455 (555) rotates about push arm lower hinge 457 (557) and guide lever 469 (569) rotates about lever arm hinge 465 (565) and guide hinge 461 (561) until push arm pin 467 (567) engages latch hook 72 (172) on latch 70 (170). As in the main embodiment, the resetting operations for the two halves of the grapple, though related to each other, are not necessarily exactly simultaneous.

Finally, the grabbing operation of the additional embodiment is identical to that of the main embodiment, except that the force from connecting arm 464 (564) acting on finger assembly 140 (40) is a downward and inward pushing force in the additional embodiment, in contrast to the upward and inward pulling force from connecting arm 64 (164) in the main embodiment.

Generally, this additional embodiment offers an operational advantage over the main embodiment in cases where it is important to reduce potential interference between the load 18 and the internal components of the grapple that could contact it, specifically lower arm mounts 58 (158) and connecting arms 64 (164) in the main embodiment. The additional embodiment has an uncluttered interior cavity and therefore reduces the possibility of interference by or with the load.

However, the main embodiment has the contrasting advantage of more significantly reducing stresses on components and shock loading on the helicopter or other supporting apparatus when the grapple is opened. For example, the force transferred in load arm 34 (134) from a pull on lever arm hinge 65 (165) to a pull on finger cable arm mount 56 (156) is less severe than the force transferred in load arm 534 (434) from a push on lever arm hinge 465 (565) to a pull on finger cable arm mount 556 (456).

All embodiments described in this disclosure, while illustrative of the essential features of the grapple apparatus and of the method described for its use, shall not be interpreted as limitations on the scope of the invention, which is capable of other expressions than those explicitly described.

What is claimed is:

1. A grapple apparatus comprising:

(a) left and right frame members having inner portions hinged together at a main hinge, (b) left and right finger assemblies each comprising plural fingers adapted to grasp a load, each of said finger assemblies being hinged by a respective finger hinge to a respective frame member, (c) left and right load arms having inner portions hinged together at said main hinge and outer portions cooperating with a load cable, (d) connecting arms connecting each of said load arms to the finger assembly on the opposite side of the grapple apparatus, (e) a latching mechanism cooperating with each of said load arms and the upper portion of a respective connecting arm, capable of engagement and disengagement such that, when engaged, the latching mechanism retains the connecting arm in a position relative to its corresponding load arm whereby lift applied to the load arm causes the finger assembly with which the lower portion of said connecting arm cooperates to move inward relative to said finger hinge, and such that, when disengaged, the latching mechanism releases the connecting arm, permitting the finger assembly with which the lower portion of said connecting arm cooperates to move unconstrained by the latching mechanism, and (f) finger cables connecting each of said load arms to the finger assembly on the same side of the grapple apparatus.

2. The grapple apparatus of claim 1, further comprising:

(a) a main stop assembly cooperating with said left and right frame members to limit rotation of the same about said main hinge.

3. The grapple apparatus of claim 2, wherein said main stop assembly comprises:

(a) a rod flexibly joined to both of said frame members permitting inward and outward rotation of the same about said main hinge, (b) a plurality of holes in said rod at various points along its length, and (c) a pin that may be placed in one of said holes to obstruct the motion of one of said frame members.

4. The grapple apparatus of claim 1, further comprising:

(a) a plurality of finger stops cooperating with said finger assemblies and said frame members to limit angular relationship between each finger assembly and the respective frame member.

5. The grapple apparatus of claim 1, in which:

(a) said fingers are curved.

6. The grapple apparatus of claim 5, in which:

(a) the curvature of said fingers approximately traces an arc of a circle centered at the nearest finger hinge.

7. The grapple apparatus of claim 1, in which:

(a) said connecting arms are arranged to exert pulling force on the inward-facing portions of said finger assemblies, whereby said finger assemblies are pulled together to grab or ferry a load.

8. The grapple apparatus of claim 7, in which:

(a) said connecting arms are articulated so that only a small retaining force on said connecting arms, relative to the weight of the load, is required to hold said finger assemblies together when grabbing or ferrying a load.

9. The grapple apparatus of claim 1, in which:

(a) said connecting arms are arranged to exert pushing force on the outward-facing portions of said finger assemblies, whereby said finger assemblies are pushed together to grab or ferry a load.

10. The grapple apparatus of claim 9, in which:

(a) said connecting arms are articulated so that only a small retaining force on said connecting arms, relative to the weight of the load, is required to hold said finger assemblies together when grabbing or ferrying a load.

11. The grapple apparatus of claim 1, in which:

(a) said latching mechanism is disengaged only by an electrical control switch.

12. The grapple apparatus of claim 1, further comprising:

(a) springs connecting each load arm to the opposing frame member to assist in engaging said latching mechanism.

13. The grapple apparatus of claim 1, in which:

(a) said finger cables pull said finger assemblies upward and outward to assist in opening the grapple apparatus when releasing a load.

14. The grapple apparatus of claim 13, in which:

(a) said finger cables are kept under tension prior to releasing the load in order to reduce shock loads transferred along said load cable when the grapple apparatus is opened.

15. The grapple apparatus of claim 1, further comprising:

(a) damping mechanisms to absorb shock when the grapple apparatus is opened.

16. The grapple apparatus of claim 1, in which:

(a) said load cables are connected above the grapple apparatus to a single main cable for towing.

17. The grapple apparatus of claim 16, in which:

(a) said load cables are connected to each other and allowed to travel freely over a pulley which is connected to said main cable, permitting angular movement of the grapple relative to a horizontal plane, whereby the grapple may adapt automatically to the slope of the ground over which it is positioned.

18. The grapple apparatus of claim 1, in which:

(a) said latching mechanism is engaged only by the weight of said load arms.

19. A method of grasping, lifting, and releasing a load with the grapple of claim 1, the method comprising the steps of:

(a) supporting the grapple above a load lying on the ground so that a pair of arms of the grapple extend generally outwardly from a centrally placed main hinge, and two sets of fingers of the grapple extend generally downwardly in an open position thereof, (b) relieving the arms of the grapple from weight of the grapple, so that weight of the arms lowers the arms while the two sets of fingers remain in said open position, (c) resetting a latching mechanism associated with the arms and fingers as the arms are lowered, so that the latching mechanism engages the connection between each connecting arm and the respective load arm, (d) raising the arms so that the reset latching mechanism is subjected to force from the grapple, causing the fingers to penetrate into and under the load, using the weight of the grapple and load to improve grasping and retention of the load, and (e) releasing the latching mechanism so that the connection between each connecting arm and the respective load arm disengages, and force from the grapple causes relative movement between the arms and fingers causing the fingers to at least partially open to release the load, while tension in cables linking the fingers and arms further opens the fingers.

20. The method of claim 19, further characterized by:

(a) generating the force necessary to execute said steps (a) through (d) of the method from lift applied to the grapple and from the weight of the grapple, its components, and its load.

21. The method of claim 20, wherein said step (b) is further characterized by:

(a) relieving the arms of weight by relieving tension in a supporting cable.

22. The method of claim 20, wherein said step (c) is further characterized by:

(a) resetting said latching mechanism by mechanical forces due to the weight of the arms.

23. The method of claim 19, wherein said step (e) is further characterized by:

(a) releasing said latching mechanism by an electrical control operable by a remote user.

24. The method of claim 19, wherein said step (e) is further characterized by:

(a) when releasing said latching mechanism, deliberately retarding opening of the fingers to reduce shock loads that would otherwise be generated during opening of the grapple.

* * * * *